US008822803B2

(12) United States Patent
Terry

(10) Patent No.: US 8,822,803 B2
(45) Date of Patent: Sep. 2, 2014

(54) DYNAMIC DIATONIC INSTRUMENT

(71) Applicant: Ableton AG, Berlin (DE)

(72) Inventor: Jesse Terry, New York, NY (US)

(73) Assignee: Ableton AG, Berlin (DE)

( * ) Notice: Subject to any disclaimer, the term of this patent is extended or adjusted under 35 U.S.C. 154(b) by 0 days.

(21) Appl. No.: 14/023,930

(22) Filed: Sep. 11, 2013

(65) Prior Publication Data

US 2014/0076126 A1 Mar. 20, 2014

(30) Foreign Application Priority Data

Sep. 12, 2012 (EP) ..... 12184092

(51) Int. Cl.

| | |
|---|---|
| ***G10H 1/32*** | (2006.01) |
| ***G10H 7/00*** | (2006.01) |
| ***G10H 1/34*** | (2006.01) |

(52) U.S. Cl.

CPC ..... *G10H 7/00* (2013.01); *G10H 2220/251* (2013.01); *G10H 2210/565* (2013.01); *G10H 2210/525* (2013.01); *G10H 2220/241* (2013.01); *G10H 1/34* (2013.01)

USPC ..... 84/644; 84/744

(58) Field of Classification Search

CPC ..... G06F 3/0219; G06F 3/04895; G10H 1/34; G10H 2220/251; G10H 2210/401; G09B 15/003; G10G 1/02

USPC ..... 84/644, 719, 744

See application file for complete search history.

(56) References Cited

U.S. PATENT DOCUMENTS

| | | | |
|---|---|---|---|
| 1,685,401 | A | 9/1928 | Fellows |
| 1,795,468 | A | 3/1931 | Bonilla |
| 3,342,094 | A | 9/1967 | Wilson |
| 3,417,648 | A | 12/1968 | Honig |
| 3,468,209 | A | 9/1969 | Barreto |
| 3,973,460 | A | 8/1976 | Coles |
| 4,009,633 | A | 3/1977 | Coles |
| 4,031,800 | A | 6/1977 | Thompson |
| 4,083,286 | A | 4/1978 | Faulkner |

(Continued)

FOREIGN PATENT DOCUMENTS

| | | | |
|---|---|---|---|
| EP | 2 434 480 | A1 | 3/2012 |
| WO | 90/07771 | A1 | 7/1990 |
| WO | 2006/084325 | A1 | 8/2006 |

OTHER PUBLICATIONS

William Sethares, et al; "Isomorphic Controllers and Dynamic Tuning: Invariant Fingering over a Tuning Continuum", Computer Music Journal, vol. 31, Issue 4, pp. 15-32; Winter 2007.

(Continued)

*Primary Examiner* — Jeffrey Donels
(74) *Attorney, Agent, or Firm* — Ladas & Parry LLP

(57) ABSTRACT

A musical instrument comprising buttons for playing notes is disclosed, wherein the buttons are arranged in an isomorphic layout consisting of rows and columns, characterized by means for choosing between a diatonic and a chromatic layout of the buttons and by means for choosing between different keys and scales. The buttons can be velocity and/or pressure sensitive, they can be backlit in different colors and they can have a dynamic note information thereon. When the layout is diatonic, the scales are arranged horizontally in rows, the rows being vertically spaced in relative fourths: when the layout is chromatic, the buttons corresponding to the scale notes of the selected key are lit in way different from the other keys.

7 Claims, 5 Drawing Sheets

(56) References Cited

U.S. PATENT DOCUMENTS

| | | | | |
|---|---|---|---|---|
| 4,384,503 | A * | 5/1983 | Gunn | 84/653 |
| 5,099,738 | A | 3/1992 | Hotz | |
| 5,440,071 | A | 8/1995 | Johnson | |
| 5,502,274 | A | 3/1996 | Hotz | |
| 5,557,057 | A * | 9/1996 | Starr | 84/617 |
| 5,619,003 | A | 4/1997 | Hotz | |
| 5,741,990 | A * | 4/1998 | Davies | 84/423 R |
| 6,100,462 | A | 8/2000 | Aoki | |
| 6,392,131 | B2 * | 5/2002 | Boyer | 84/424 |
| 6,444,888 | B1 * | 9/2002 | VanDruff | 84/609 |
| 6,448,486 | B1 | 9/2002 | Shinsky | |
| 6,501,011 | B2 * | 12/2002 | Wesley | 84/719 |
| 7,273,979 | B2 * | 9/2007 | Christensen | 84/615 |
| 8,558,723 | B2 * | 10/2013 | Robinson et al. | 341/23 |
| 2002/0134223 | A1 | 9/2002 | Wesley | |
| 2005/0226408 | A1 | 10/2005 | Hotz | |
| 2006/0011044 | A1 | 1/2006 | Chew | |
| 2006/0123982 | A1 | 6/2006 | Christensen | |
| 2007/0022865 | A1 | 2/2007 | Nishibori et al. | |
| 2007/0022868 | A1 | 2/2007 | Nishibori et al. | |
| 2007/0240559 | A1 | 10/2007 | Hasebe | |
| 2008/0072738 | A1 | 3/2008 | Plamondon et al. | |
| 2009/0114078 | A1 * | 5/2009 | Plamondon | 84/423 R |
| 2011/0100198 | A1 | 5/2011 | Gatzsche et al. | |
| 2011/0273700 | A1 * | 11/2011 | Lambert et al. | 356/28 |
| 2012/0031254 | A1 * | 2/2012 | Hotrique | 84/423 R |

OTHER PUBLICATIONS

Douglas Keislar; "History and Principles of Microtonal Keyboard Design", CCRMA Department of Music, Stanford University Center for Computer Research in Music and Accoustics, Report No. STAN-M-45; XP-002620565, Apr. 1968; 19 pages.

Polyplayground; Retrieved from the Internet: http://itunes.apple.com/us/app/polyplayground/id511514938?mt=8 http://www.xlr8r.com/gear/2012/04/review-polyplayground-ipad, Apr. 2012.

Synthtastic, Mugician; Retrieved from the Internet: http://wwsynthtopia.com/content/2011/11/10/synthtastic/ http://rrr00bb.blospot.de/, Oct. 11, 2011.

ANIMOOG; Online; Information: http://www.moogmusic.com/products/apps/animoog-999-until-5292012, May 29, 2012.

DIY Isomorphic Keyboard; May 7, 2012 Retrieved from the Internet: http://rainboard.shiverware.com/Rainboard—DIY Dynamic Rainbow Isomorphic Keyboard.

MUSIX; Jul. 7, 2012 Retrieved from the Inernet: http://web.archive.org/web/20120707055513/http://www.shiverware.com.

Steven Maupin, et al; "Isomorphic Tessellations for Musical Keyboards", Jan. 1, 2011; Retrieved from the Internet: http://smcnetwork.org/system/files/smc2011__submission__169.pdf.

* cited by examiner

| | | | | | | | |
|---|---|---|---|---|---|---|---|
| B3 | C4 | C#4 | D4 | D#4 | E4 | F4 | F#4 |
| F#3 | G3 | G#3 | A3 | A#3 | B3 | C4 | C#4 |
| C#3 | D3 | D#3 | E3 | F3 | F#3 | G3 | G#3 |
| G#2 | A2 | A#2 | B2 | C3 | C#3 | D3 | D#3 |
| D#2 | E2 | F2 | F#2 | G2 | G#2 | A2 | A#2 |
| A#1 | B1 | C2 | C#2 | D2 | D#2 | E2 | F2 |
| F1 | F#1 | G1 | G#1 | A1 | A#1 | B1 | C2 |
| C1 | C#1 | D1 | D#1 | E1 | F1 | F# | G1 |

Fig. 2 (Prior Art)

DYNAMIC DIATONIC INSTRUMENT

FIELD OF THE INVENTION

The present invention is directed to a dynamic diatonic instrument which has an isomorphic layout of keys/buttons.

BACKGROUND AND PRIOR ART

Conventional pianos and keyboards are ubiquitous with a standardized linear series of white and black keys/buttons arranged from left to right in ascending order. The white keys/buttons represent the diatonic C major scale, and the black keys/buttons represent the sharps or flats. This layout allows performance of chords and scales in all twelve chromatic keys of western music. However, the piano layout has limitations and takes years of practice to master, needing different hand positions and patterns of notes for performing chords and scales in different keys.

Even before the introduction of electronic musical instruments, isomorphic grid keyboards have already been developed. These keyboards improve on the traditional piano's design, by creating symmetrical grids of buttons with rows and columns, which make chords and scales easier to play. One can memorize a few shapes, and move it around to play different chords. Isomorphic grids are also better adapted to typical hand shapes, easier placement of fingers, and for playing large intervals. However, a musician still needs to understand music theory to play different chords and scales in different keys. An "isomorphic" keyboard is a keyboard wherein (1) the keys are typically arranged as a vertical and horizontal grid of note buttons and (2) intervals between notes on the keyboard are associated to fingering having the same (or similar) shape (cf., for example, the Merriam-Webster dictionary for the definition of "isomorphic"). In this respect, prior art "isomorphic" keyboards have a fixed chromatic keyboard layout (like the one shown in FIG. 2 of the present application) and permit fingering patterns which are invariant to real transposition such that, for example, major triads in different keys (C, D, E etc.) have the same fingering pattern when the hand is moved to different places on the keyboard. However, minor triads, for example, have a different fingering pattern than major triads, and this difference cannot be compensated by moving the hand over the keyboard. Accordingly, prior art "isomorphic" chromatic keyboards still require an extensive knowledge of music theory to understand, apply and learn the different fingering patterns: The fingering pattern has to be changed, for example, for switching between a major and a minor triad.

A whole tone keyboard can be isomorphic—see, for example, the Janko keyboard which uses two rows with whole tones, set apart by a whole tone. However, it is neither diatonic nor tuning invariant—although tuning invariance requires an isomorphic layout, not every isomorphic layout is tuning invariant. The same applies to the Accordion.

U.S. Pat. Nos. 1,685,401 A, 3,417,648 A and 1,795,468 A all disclose symmetrical mechanical isomorphic keyboards, some of them intended for different tunings or temperaments. However, they are neither diatonic nor adaptive nor are they intended for the use with software. Furthermore, they use older forms of layouts.

U.S. Pat. Nos. 3,342,094 A and 3,468,209A both disclose mechanical isomorphic keyboards in a matrix shape which are arranged in 4ths. However, like the prior art mentioned above, they are neither diatonic nor adaptive nor are they intended for the use with software. Modern iOS applications such as Synthtastic, PolyPadPlayground and Mugician are similar in that they use a square isomorphic grid (and even often colors to indicate harmony). However, they are not adaptive or diatonic, either. On the other hand, ToneSpace is a software plugin which has diatonic assist, but it is still not fully dynamic.

U.S. Pat. No. 4,031,800 A and US 2008/072738 A1 disclose symmetrical mechanical isomorphic keyboards with hexagonal buttons. However, they are neither diatonic nor adaptive. There are similar hardware pieces on the market such as the Axis-64. There are also applications which follow the hexagonal layout, but they are neither diatonic nor adaptive, either—see, for example, hexaChrome, Hex OSC Full & Hex OSC S, Musix.

US 2007/022868 A1 and US 2007/022865 A1 disclose a matrix shaped backlit instrument (Tenori-On) which is adaptive—however, the usage is pertaining to rhythmic 'step sequencing'.

U.S. Pats. Nos. 5,099,738 A, 5,502,274 A and 5,619,003 A disclose an electronic musical instrument including a keyboard which makes use of different note tables such that the user can choose therefrom when using the keyboard. This instrument is diatonic and adaptive—however, it is not isomorphic such that the gains in terms of learning chord shapes are still limited. In a similar way, the application Moog Animoog uses a dynamically adaptive diatonic piano keyboard—however, it is not isomorphic, either, with the same consequence that there are no gains in terms of learning chord shapes.

US 2011/100198 A discloses a device and method for generating a note signal upon a manual input, wherein control means generates the note signal on the one hand on the basis of the input signal and on the other hand on the basis of the allocation function. The allocation function is defined via a two-dimensional definition amount comprising a tone quality axis and a frequency axis or tone pitch information axis, and the tone qualities are represented on a first axis. The definition amount based on the coordinate system further comprises a second axis on which the tones are arranged—for this reason, the same is also referred to as tone axis or frequency axis. Accordingly, US 2011/100198 A does neither disclose an isomorphic keyboard nor a chromatic or diatonic keyboard, either, but a device with a tone generating matrix which more resembles the original Moog synthesizer.

US 2006/011044 A discloses a method of composing music on a handheld device, wherein a musical sequence is formed on the keypad of a handheld device. The numbered keys on the keypad of the handheld device are mapped to corresponding notes in an octave. The sequence of musical notes is entered by depressing at least one numbered key on the keypad and displaying a numerical representation of the sequence on the display screen of the handheld device. Accordingly, like US 2011/100198 A above, there is neither disclosure relating to an isomorphic keyboard nor a chromatic or diatonic keyboard, but merely a handheld device such as a mobile phone where musical sequences are stored.

The article "Isomorphic Controllers and Dynamic Tuning: Invariant Fingering over a Tuning Continuum" (W. Sethares et al., in: Computer Music Journal, December 2007, p. 15ff) discusses "tuning invariance" in general, and one conclusion is that it requires an isomorphic layout—however, although tuning invariance requires an isomorphic layout, not every isomorphic layout is tuning invariant.

The link "http://web.archive.org/web/20120724051804/http://robertinventor.com/ software/tunesmithy/mouse_and_pc_keyboard_music.htm" shows a software program without physical buttons but using a computer keyboard as a controller which has a diagonal layout without vertical columns. The purpose of this program is to explore a variety of non-standard tunings and to study microtonality. The computer with this program is not easy to play or finger because the scales are not implemented to wrap to different rows in a way that would make fingering of scales and chords easy. Although it can be chosen which not a button sends (which applies to any MIDI device), whole layouts cannot be changed—this could only be achieved by changing to a menu which, however, does not make a change from, e.g., D major to c minor possible without custom coding.

Thus, there is still a need for an instrument which enables its user to easily play scales or chords in any key with little musical training.

BRIEF DESCRIPTION OF THE DRAWINGS

FIG. 2 shows a prior art chromatic isomorphic layout.

SUMMARY OF THE INVENTION

The object of this invention is to provide a musical instrument for generating notes or tones and easily playing scales or chords in any key such that it can be played with little musical training. A particular aspect is to eliminate disadvantages of traditional piano keyboards with their "black keys/buttons" and "white keys/buttons" and prior isomorphic grid keyboards with rows and columns of buttons.

This is achieved by a musical instrument according to claim 1. The musical instrument has a grid of buttons for playing notes which are arranged in an isomorphic layout, characterized by means for choosing between a diatonic and a chromatic layout of the buttons and by means for choosing between different keys and scales.

Further advantageous aspects can be obtained from the dependent claims.

DETAILED DESCRIPTION OF THE PREFERRED EMBODIMENTS

In a preferred embodiment, the musical instrument according to the present invention is made up of

- a two dimensional (8×8) grid of 64 velocity and pressure/velocity sensitive multicolor backlit buttons,
- twelve buttons to select the tonal center,
- two buttons to select the scale (i.e. major, minor etc.),
- a button to toggle between diatonic and chromatic layouts, and
- a screen to deliver key and scale information.

Figure 1:
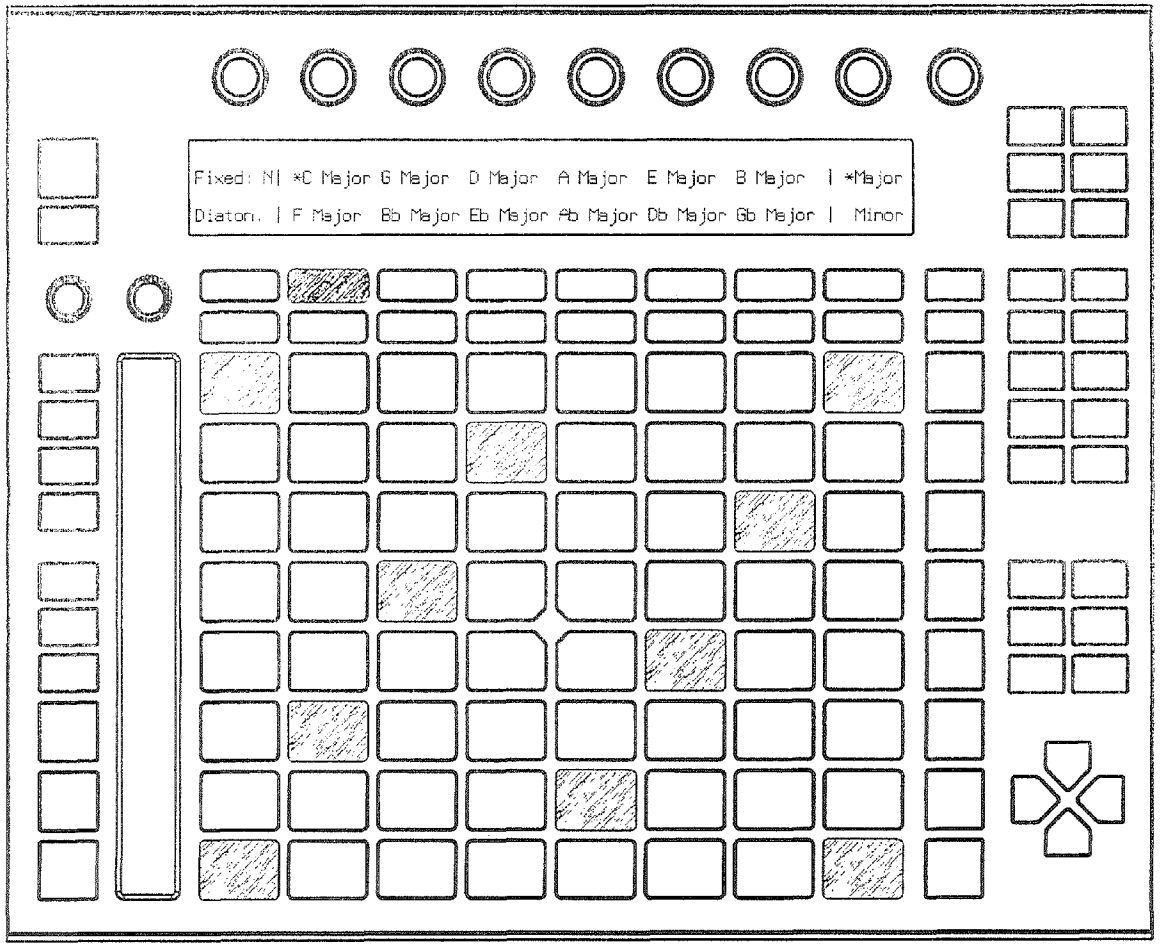
FIG. 1 shows an embodiment of the instrument according to the present invention.

FIG. 1 shows the general arrangement of this instrument. Each button in the grid sends a variable MIDI note message, advantageously with velocity and pressure information, and may independently be backlit with a multi-color (RGB) LED. The note sent—and optionally the color of the button—can be dynamically changed depending on what key and what scale is selected.

The tones represented by the buttons can be arranged horizontally from left to right or vertically from bottom to top—the desired arrangement can be selected in a preferences area. In the following, however, the embodiments of the present invention will be explained in connection with the default layout where the tones are arranged horizontally in rows which are, in turn, arranged vertically by fourths, similar to the Guitar.

Prior art isomorphic keyboards offer a chromatic layout an example of which is shown in FIG. 2. In this example, the grid has eight rows with eight buttons each, wherein the rows are vertically spaced by fourths such that the tones are arranged as C, C#, D, D#, E, F, F#, G in the bottom row, F, F#, G, G#, A, Bb, B and C in the second row etc. Such a layout is useful, but it still requires an extensive knowledge of music theory to understand, and requires learning many different shapes to play different chords and various scales.

Figure 3:
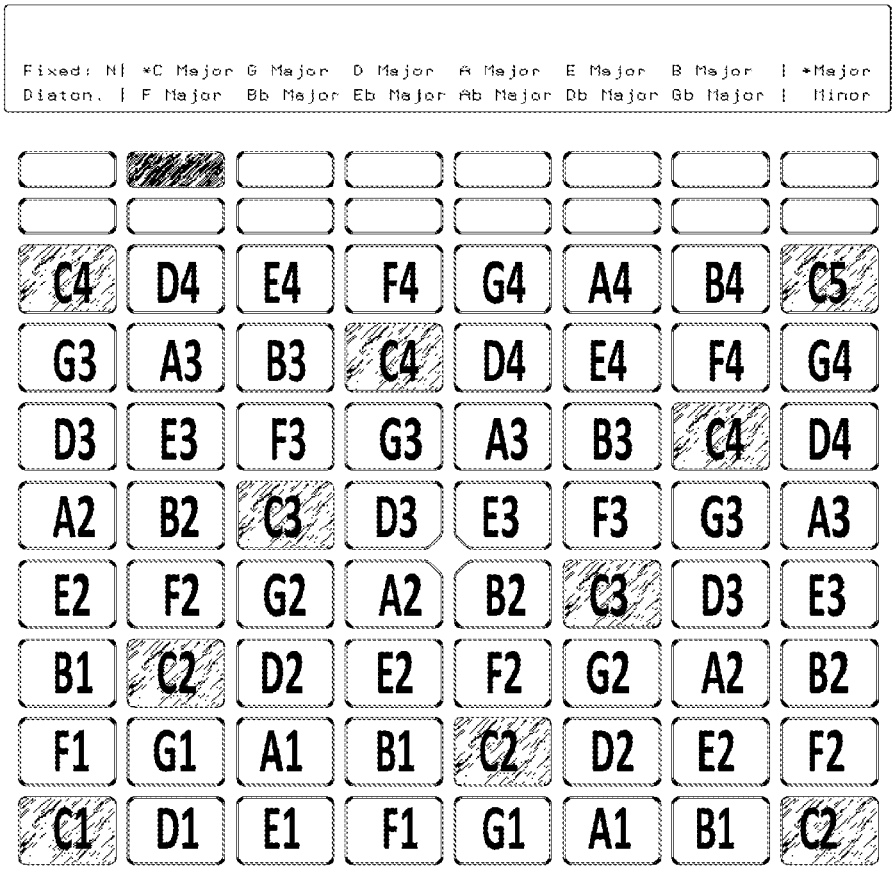
FIG. 3 shows an example of the diatonic isomorphic layout according to the present invention.

The improvement of the present invention in comparison to the prior art are means for choosing between a diatonic and chromatic layout of the buttons in the form of a "diatonic/chromatic" toggle, which allows to change from a chromatic to a diatonic grid. An example of such a diatonic grid—here: C major—is shown in FIG. 3. In C major this grid does not have the additional "black keys/buttons" from the piano but only the "white keys/buttons" which form the C major scale. As can be obtained from FIG. 3, each row of buttons now includes a whole scale and each subsequent row is now not exactly a perfect fourth about the preceding row but a relative fourth - to make sure every note pressed is in the correct key. In an alternative embodiment, the "diatonic/chromatic" toggle can be omitted, the instrument then having a diatonic layout only.

Figure 4A:
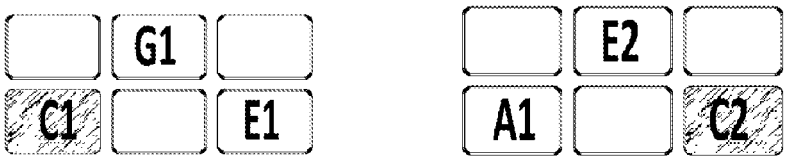
FIG. 4A shows the shape of major and minor chords in the layout of FIG. 3.
Figure 4B:
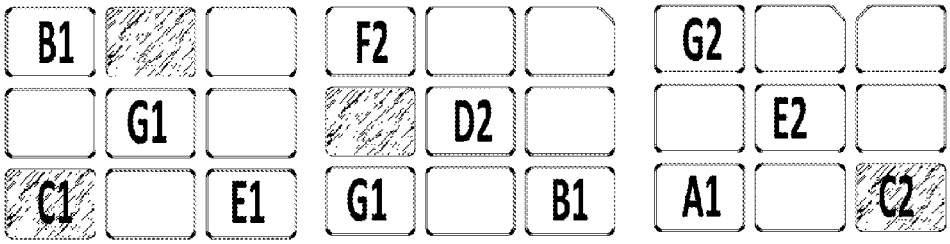
FIG. 4B shows the shape of major and minor chords with an additional major or minor seventh in the layout of FIG. 3.
Figure 4C:
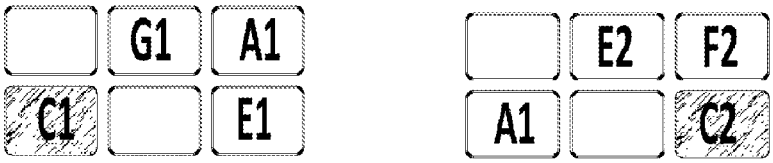
FIG. 4C shows the shape of major and minor chords with an additional sixth in the layout of FIG. 3.
Figure 4D:
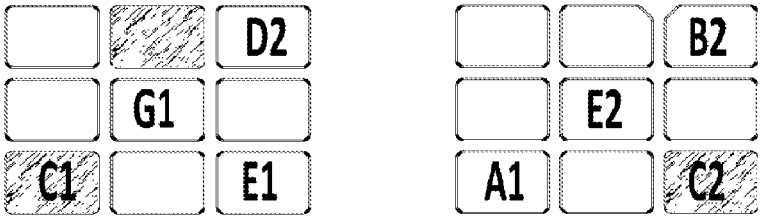
FIG. 4D shows the shape of major and minor chords with an additional major ninth in the layout of FIG. 3.

Such an arrangement of buttons takes away many challenges of learning to play scales and chords in any key, and increases the instrument range. With such a layout, playing the notes of a C major chord (C, E, G) and an A minor chord (A, C, E), resp., is the same simple shape in both cases which is easy to remember—the shape for the C major chord and the A minor chord, resp., can be obtained from FIG. 4A. In a similar way, all triadic chords with an additional seventh share the same shape, the shape being the same for chords in major and minor scales as well as with a major seventh or a minor seventh—the shape for the C major chord with a major seventh, the G major chord with a minor seventh and the A minor chord with a minor seventh, resp., can be obtained from FIG. 4B. Again, in a similar way, all triadic chords with an additional sixth share the same shape, the shape being the same for chords in major and minor scales—the shape for the C major chord with a sixth and the A minor chord with a sixth, resp., can be obtained from FIG. 4C. Again, in a similar way, all triadic chords with an additional major ninth share the same shape, the shape being the same for chords in major and minor scales—the shape for the C major chord with a major ninth and the A minor chord with a major ninth, resp., can be obtained from FIG. 4D.

Figure 5:
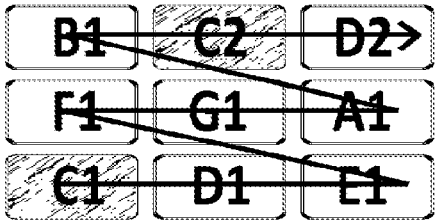
FIG. 5 shows the C major scale in the layout of FIG. 3 as an example for the scale pattern which applies to all keys.

The examples for chord shapes above were given for the C major layout of FIG. 3. However, the chord shapes even remain the same for all keys—such that, for example, a D major chord and a D minor chord, resp., has the same shape in the D major and D minor layout, resp., as the C major chord in the C major layout of FIG. 3. Similarly, playing a major or minor scale is a simple repetitive gesture, the same pattern of which can be repeated in any key—see, for example, the C major scale in FIG. 5. According to the present invention, this is achieved via means for choosing between different keys and scales in the form of twelve "transition" buttons which can be seen at the top of FIG. 1 as "C Major", "G Major", . . . "F Major", Bb Major" etc. and which give access to all twelve keys and via two "scale select" buttons for selecting the scale (major, minor etc.). It should be noted that, as an alternative, twenty four buttons can be used, each to select key and scale at the same time. (Optionally, auxiliary buttons can be added to move up or down an octave allowing for ease of access to every diatonic chord.) This key/scale changing feature turns a static layout into a dynamic one such that the change from C major to D major is achieved by shifting all keys/notes in the layout of FIG. 1 by one full tone in the following way

C→D
D→E
E→F#
F→G
G→A
A→B
B→C#, whereas the change from C major to D minor is achieved by shifting some keys/notes in the layout of FIG. 1 by one full tone and some only by a half tone in the following way C→D
D→E
E→F
F→G
G→A
A→Bb
B→C.

The correct correspondence between the buttons and the notes (MIDI out functionality in case of the MIDI standard) in each key and scale can be achieved by applying a table in a codebase when the respective transition button and/or scale select button is pressed. The following is one example of many (here in Python script format, but any other programming languages can be used, of course):

```
# Major 4th Horizontal - diatonic
""""" MIDI note values for for C Major Diatonic > P4 """"
NOTEMAP_M4_H_D = ((72, 74, 76, 77, 79, 81, 83, 84), #Row 1
        (67, 69, 71, 72, 74, 76, 77, 79), #Row 2
        (62, 64, 65, 67, 69, 71, 72, 74), #Row 3
        (57, 59, 60, 62, 64, 65, 67, 69), #Row 4
        (52, 53, 55, 57, 59, 60, 62, 64), #Row 5
        (47, 48, 50, 52, 53, 55, 57, 59), #Row 6
        (41, 43, 45, 47, 48, 50, 52, 53), #Row 7
        (36, 38, 40, 41, 43, 45, 47, 48), #Row 8
        )
```

Thus, by pressing one of the twelve transition buttons the user selects the desired key, and by pressing one of the two scale select buttons he selects the scale (major, minor). The present invention thus provides a dynamic diatonic instrument when the diatonic layout is chosen via the "diatonic/chromatic" toggle mentioned above.

Due to the features described above, the present invention discloses an instrument which provides all the features of prior art isomorphic keyboards in chromatic mode, but expands on this with diatonic isomorphism. The dynamic diatonic instrument according to the present invention has one shape for all major, minor and diminished chords and, thus, extends the "transpositional invariance" of prior art isomorphic keyboards: It is also "tonal transpositionally invariant" (i.e., within a scale)—not only is it transpositionally invariant in a "real" sense in chromatic mode, but it is diatonically transpositionally invariant in a "key" mode, i.e., the user can transpose a melody with the same fingering pattern and remain in the same key if desired. To summarize, the inventive "isomorphic" diatonic keyboard is not only invariant to real transposition (for example, from major to major) by using the transposition key center buttons above the 8×8 grid to change the key center (cf. FIG. 3) but also to tonal transposition (for example, from major to minor) by using the scale select buttons above the right column of key buttons (cf. FIG. 3). Thus, the user only has to learn a chord shape in one key and scale and can then easily transpose it to any other key and scale. Prior art isomorphic chromatic keyboards are only useful for real transposition—in contrast thereto, the present invention also permits invariant tonal transpositions such that a triad will always remain a triad with one and the same fingering pattern. Moreover, the same fingering pattern could not just apply to a major or a minor chord but also to a diminished chord—depending on where the hand moves on the 8×8 grid. Likewise, for playing scales, one only has to learn one scale pattern to play any type of scale (e.g. major, minor, super locrian etc.) in any transposition.

Further advantageous features can be implemented. For example, the buttons can be dynamically lit in such a way that the LED color pattern numbers send a midi message which communicates with the firmware of the device to update the lighting in realtime. Like in the example above regarding the correspondence between the buttons and the notes a codebase is used when the respective transition button is pressed. The following is again an example in Python script format:

```
# Major 4th Horizontal - diatonic
""""" LED color pattern for C Major Diatonic > P4 ^ " """"
PATTERN_M4_H_D = ((07, 05, 05, 05, 05, 05, 05, 07), #Row 1
        (05, 05, 05, 07, 05, 05, 05, 05), #Row 2
        (05, 05, 05, 05, 05, 05, 07, 05), #Row 3
        (05, 05, 07, 05, 05, 05, 05, 05), #Row 4
        (05, 05, 05, 05, 05, 07, 05, 05), #Row 5
        (05, 07, 05, 05, 05, 05, 05, 05), #Row 6
        (05, 05, 05, 05, 07, 05, 05, 05), #Row 7
        (07, 05, 05, 05, 05, 05, 05, 07), #Row 8
        )
```

Additionally, there can be extra code to handle correct note on and off messaging when changing to different keys (avoiding the problem of "Stuck Notes").

Figure 6:
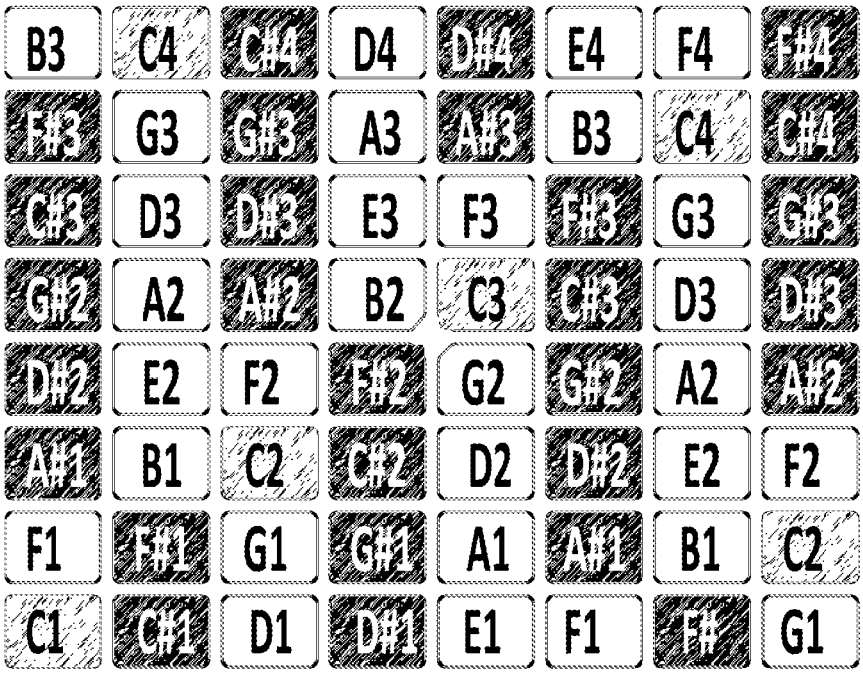
FIG. 6 shows a chromatic isomorphic layout where the "white keys/buttons" for C major are lit.

FIG. 6 shows another embodiment of the present invention where a chromatic isomorphic layout has been chosen via the "diatonic/chromatic" toggle but with the improvement over the prior art that the buttons corresponding to the "white keys/buttons" of the piano are lit, the "root note" button being lit in a different color (the root of C major can be indicated in orange, for example). It is also possible to show the note or chord name on the respective button. A further improvement of the present invention is that the key center (as well as the scale) can be dynamically changed as explained above, which updates the lighting of the buttons to indicate the new "white keys/buttons".

The present invention can be used for controlling tone generating synthesizers and virtual instruments on a computer and may be implemented as a software or hardware controller that generates MIDI notes.

The invention claimed is:

1. A musical instrument comprising buttons for playing notes comprising:

buttons arranged in an isomorphic layout consisting of rows and columns;

a layout format selector to select a layout from the group consisting of a diatonic layout of the buttons, wherein a certain diatonic scale in a certain key is selected and wherein each row consists of consecutive notes of said scale in said key, and a chromatic layout of the buttons, wherein each row consists of consecutive notes of the chromatic scale;

a key selector to select said certain key; and a scale selector to select said certain diatonic scale.

2. Musical instrument according to claim 1, wherein the buttons are selected from the group consisting of velocity and pressure sensitive buttons.

3. Musical instrument according to claim 1, wherein the buttons are backlit.

4. Musical instrument according to claim 3, wherein the buttons are backlit in different colors.

5. Musical instrument according to claim 3, wherein the buttons have a dynamic note information thereon.

6. Musical instrument according to claim 1, wherein the layout is diatonic and wherein the scales are arranged horizontally in rows, the rows being vertically spaced in relative fourths.

7. Musical instrument according to claim 1, wherein the layout is chromatic and wherein the buttons corresponding to the scale notes of the selected key are lit in way different from the other keys.

* * * * *